US007655286B2

(12) United States Patent
DeMejo et al.

(10) Patent No.: US 7,655,286 B2
(45) Date of Patent: Feb. 2, 2010

(54) FUSIBLE REACTIVE MEDIA COMPRISING MORDANT

(75) Inventors: Lawrence P. DeMejo, Rochester, NY (US); Xiaoru Wang, Webster, NY (US); Gregory E. Missell, Penfield, NY (US); Allan Wexler, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 796 days.

(21) Appl. No.: 10/881,264

(22) Filed: Jun. 30, 2004

(65) Prior Publication Data

US 2006/0003112 A1 Jan. 5, 2006

(51) Int. Cl.
*B41M 5/40* (2006.01)

(52) U.S. Cl. ..... 428/32.15; 428/32.25; 428/32.26; 428/32.28; 428/32.3; 428/32.35; 428/32.38; 347/101; 347/105

(58) Field of Classification Search ..... 428/32.26, 428/32.15, 32.28, 32.3, 32.35, 32.38, 32.25; 347/101, 105

See application file for complete search history.

(56) References Cited

U.S. PATENT DOCUMENTS

| | | | | |
|---|---|---|---|---|
| 6,346,353 | B1 | 2/2002 | Wang et al. | |
| 6,436,617 | B1 | 8/2002 | Wang et al. | |
| 6,497,480 | B1 | 12/2002 | Wexler | |
| 6,534,156 | B1 * | 3/2003 | Baker et al. | 428/195.1 |
| 6,548,182 | B1 | 4/2003 | Field et al. | |
| 6,695,447 | B1 * | 2/2004 | Wexler | 347/105 |
| 2004/0090512 | A1 * | 5/2004 | Yau et al. | 347/105 |
| 2006/0003112 | A1 * | 1/2006 | DeMejo et al. | 428/32.24 |

FOREIGN PATENT DOCUMENTS

EP 1 188 573 A2 3/2002

* cited by examiner

*Primary Examiner*—Betelhem Shewareged
(74) *Attorney, Agent, or Firm*—Chris P. Konkol; Arthur E. Kluegel; Andrew J. Anderson

(57) ABSTRACT

An inkjet recording element comprising a support having thereon in order, from top to bottom, a fusible, porous ink-transporting layer comprising fusible polymeric particles, which particles comprise a thermoplastic polymer with reactive functional groups, the ink-transporting layer further comprising a multifunctional compound having complementary reactive functional groups capable of crosslinking the reactive functional groups on the thermoplastic polymer. The ink-transporting layer is over a fusible dye-trapping layer that preferably comprises a mordant. Optionally, an ink-carrier-liquid receptive layer is present between the dye-trapping layer and the support.

29 Claims, No Drawings

FUSIBLE REACTIVE MEDIA COMPRISING MORDANT

CROSS-REFERENCE TO RELATED APPLICATIONS

The present application is related to U.S. application Ser. No. 10/881,127, filed concurrently herewith, by Demejo et al., and entitled, "Fusible Reactive Media."

FIELD OF THE INVENTION

The present invention relates to an inkjet recording element and a printing method using the element. More specifically, the invention relates to a porous media in which the top layer comprises fusible particles of a polymer having functional groups that crosslink with a crosslinking agent external to the particles when the layer is fused.

BACKGROUND OF THE INVENTION

In a typical inkjet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An inkjet recording element typically comprises a support having on at least one surface thereof at least one ink-receiving layer. The ink-receiving layer is typically either a porous layer that imbibes the ink via capillary action, or a polymer layer that swells to absorb the ink. Transparent swellable hydrophilic polymer layers do not scatter light and therefore afford optimal image density and gamut, but may take an undesirably long time to dry. Porous ink-receiving layers are usually composed of inorganic or organic particles bonded together by a binder. During the inkjet printing process, ink droplets are rapidly absorbed into the coating through capillary action, and the image is dry-to-touch right after it comes out of the printer. Therefore, porous coatings allow a fast "drying" of the ink and produce a smear-resistant image. However porous layers, by virtue of the large number of air-particle interfaces, scatter light that may result in lower densities of printed images.

Furthermore, inkjet prints prepared by printing onto inkjet recording elements are subject to environmental degradation. They are especially vulnerable to damage resulting from contact with water and atmospheric gases such as ozone. The damage resulting from the post-imaging contact with water can take the form of water spots resulting from deglossing of the top coat, dye smearing due to unwanted dye diffusion, and even gross dissolution of the image recording layer. Ozone can bleach inkjet dyes resulting in loss of density. To overcome these deficiencies, inkjet prints are often laminated. However, lamination is expensive, as it requires a separate roll of material.

Efforts have been made to avoid lamination and yet provide protected inkjet prints by providing an inkjet receiver having an uppermost fusible ink-transporting layer and an underlying ink-retaining layer.

Inkjet elements having a fusible porous upper layer are known in the art. Fusing the upper layer after printing the image has the advantage of providing a protective overcoat for water and stain resistance and reducing light scatter for improved image quality.

For example, U.S. Pat. Nos. 4,785,313 and 4,832,984 relate to an inkjet recording element comprising a support having thereon a porous fusible, ink-transporting layer and a swellable polymeric ink-retaining layer, wherein the ink-retaining layer is non-porous.

EP 858, 905A1 relates to an inkjet recording element having a porous fusible ink-transporting outermost layer formed by heat sintering thermoplastic particles, and an underlying porous layer to absorb and retain the ink applied to the outermost layer to form an image. The underlying porous ink-retaining layer is constituted mainly of refractory pigments. After imaging, the outermost layer is made non-porous.

EP 1,188,573 A2 relates to a recording material comprising in order: a sheet-like paper substrate, at least one pigment layer coated thereon, and at least one sealing layer coated thereon. Also disclosed is an optional dye-trapping layer present between the pigment layer and the sealing layer.

U.S. Pat. No. 6,497,480 to Wexler discloses inkjet media comprising both a fusible ink-transporting layer and a dye-trapping layer. A base layer and/or a porous under the fusible layer may be employed to absorb ink carrier-liquid fluid.

Protective overcoats and crosslinked overcoats for recording elements are also known in the art. For example, U.S. Pat. No. 6,436,617 relates to protective overcoats for photographic image elements comprising water-dispersible latex particles, which particles comprise an epoxy material and a thermoplastic acid polymer, a water-soluble hydrophilic polymer and a hydrophobically modified associative thickener. The hydrophilic polymer is substantially washed out during photographic processing facilitating the coalescence of the hydrophobic materials. Another driving force for this coalescence is the elevated temperature drying associated with photoprocessing.

U.S. Pat. No. 6,548,182 relates to an inkjet recording material wherein the coating comprises a water-soluble polymer having a plurality of carboxyl groups and a water-soluble oxazoline group as a crosslinking agent.

It is an object of this invention to provide a porous inkjet recording element that can be printed with inkjet inks and fused to provide high-density images. It is another object of the invention to provide a protective uppermost ink-transporting layer that is thermally fusible and thereby can be rendered water and stain resistant.

SUMMARY OF THE INVENTION

These and other objects are achieved in accordance with the invention which comprises an inkjet recording element comprising a support having thereon in order:

a) a fusible, porous ink-transporting layer comprising (i) fusible polymeric particles comprising a thermoplastic polymer with reactive functional groups, (ii) a multifunctional compound having complementary reactive functional groups capable of crosslinking the reactive functional groups on the thermoplastic polymer, and (iii) optionally a binder;

b) a fusible dye-trapping layer comprising fusible polymeric particles, a dye mordant, and an optional hydrophilic binder; and c) optionally an ink-carrier-liquid receptive layer.

The dye-trapping layer and/or the support may optionally function as a liquid-absorbing sump layer to some extent, either alone or in combination with the optional ink-carrier-liquid receptive layer.

In one embodiment of the invention, the fusible particles are substantially spherical and monodisperse. The UPA monodispersity ("Dp"), which is defined as the weight average molecular weight divided by the number average molecular weight of the polymers in the bead, is less than 1.3, preferably less than 1.1, as measured by a Microtrac Ultra Fine Particle Analyzer (Leeds and Northrup) at a 50% median value. This is another way of saying that the particle size distribution is relatively narrow which, in combination with the particle or bead size, is important for the desired capillary action.

By use of the invention, a porous inkjet recording element is obtained that when printed with an inkjet ink, and subsequently fused, has improved water resistance and stain resistance and high print density.

Inkjet media made in accordance with the present invention may exhibit advantageous properties. In some cases, the crosslinking reaction may improve gloss durability. Another advantage is that the invention allows the use of lower Tg polymers in the fusible beads, which in turn allows relatively lower fusing temperatures. By the term "thermoplastic polymer" as used herein is meant that the polymer flows upon application of heat, prior to crosslinking.

Because the thermoplastic polymer comprising the fusible polymeric particles are later crosslinked, during fusing, the polymeric particles can start at a lower Tg than polymeric particles that are not later crosslinked. After fusing, its Tg will increase due to the crosslinking, for example, from 50° C. to 100° C. Thus, the Tg of the fusible particles can optionally exist in unprinted inkjet media below the blocking temperature before fusing and, after fusing, gain the desired anti-blocking properties. This can facilitate fusing, as will be discussed below.

Another embodiment of the invention relates to an inkjet printing method comprising the steps of: A) providing an inkjet printer that is responsive to digital data signals; B) loading the inkjet printer with the inkjet recording element described above; C) loading the inkjet printer with preferably a dye-based inkjet ink composition; D) printing on the hereindescribed inkjet recording element using the inkjet ink composition in response to the digital data signals; and (E) fusing at least the uppermost ink-transporting layer and an underlying dye-trapping layer.

As used herein, the terms "over," "above," and "under" and the like, with respect to layers in the inkjet media, refer to the order of the layers over the support, but do not necessarily indicate that the layers are immediately adjacent or that there are no intermediate layers.

In regard to the present method, the term "ink-transporting layer" is used herein to mean that, in use, most (more than 50% by weight), preferably at least about 75% by weight, more preferably substantially all, of the dye colorant in the printed inkjet ink passes through and out of the ink-transporting layer.

Similarly, the term "dye-trapping layer" is used herein to mean that, in use, most (more than 50% by weight), preferably at least about 75% by weight, more preferably substantially all, of the dye colorant in the printed inkjet ink is retained in the dye-trapping layer.

DETAILED DESCRIPTION OF THE INVENTION

The fusible, polymeric particles employed in the uppermost ink-transporting layer of the invention may have a particle size conducive to forming a porous layer. In a particularly preferred embodiment of the invention, the average particle size of the fusible, polymeric particles suitably ranges from about 5 to about 10,000 nm, and the monodispersity of the particles (Dp) is less than 1.3. Preferably, the fusible, polymeric particles in said fusible, porous top layer range in size from about 50 to 5,000 nm, more preferably 0.2 to about 2 μm, most preferably 0.2 to 1 μm.

Upon fusing of the polymeric particles, the air-particle interfaces present in the original porous structure of the layer are eliminated and a non-scattering, substantially continuous, protective overcoat forms over the image. In a preferred embodiment of the invention, the fusible, polymeric particles in the ink-transporting layer comprise a cellulose ester polymer, such as cellulose acetate butyrate, a condensation polymer, such as a polyester or a polyurethane, or an addition polymer, for example, a styrenic polymer, a vinyl polymer, an ethylene-vinyl chloride copolymer, a polyacrylate, poly(vinyl acetate), poly(vinylidene chloride), and/or a vinyl acetate-vinyl chloride copolymer. In a preferred embodiment of the invention, the fusible, polymeric particles are comprised of a polyacrylate polymer or copolymer (for example, acrylic beads) comprising one or more monomeric units derived from an alkyl acrylate or alkyl methacrylate monomer, wherein the alkyl group preferably has 1 to 6 carbon atoms.

As indicated above, the fusible particles in the ink-transporting layer comprises a polymer having reactive functional groups. The weight average molecular weight of the polymer can range from 5,000 to 1,000,000, and the glass transition temperature thereof preferably ranges from −50° C. to 120° C. Preferably the Tg of the polymer particles is above about 20° C. and less than 120° C., more preferably above 50° C. and below 90° C. and most preferably below 80° C.

The polymer particles and the multifunctional chemical may be the reaction products of monomers comprising one or more non-reactive monomers and one or more reactive functional monomers. In this case, complementary reactive functional monomeric unit on the multifunctional compound will complementarily react with reactive functionalities on the bead polymer. Such reactive functional monomers may include monomers containing one or more of the following groups: cyanate, oxazoline, epoxy, acid, acid anhydride, hydroxyl, phenol, acetoacetoxy, thiol, and/or amine functionalities, and the like. Mixtures of multifunctional polymers and/or mixtures of polymer particles may be employed.

Preferably the polymer particles may comprise 0.1 to 50 mole percent of reactive monomeric units, more preferably 1 to 50 mole percent, most preferably less than 30 mole percent. Too much crosslinking can result in undesirable brittleness. The polymer particles may comprise 50 to 99.9 mole percent of non-reactive monomeric units.

Preferably the multifunctional compounds comprise 0.1 to 100 mole percent of complementary reactive monomeric units, more preferably 1 to 50 mole percent. The multifunctional compounds may comprise 0 to 99.9 mole percent of non-reactive monomeric units.

The "functional group equivalent weight" (also referred to as the weight per functional group equivalent) is defined as the grams of solid containing one gram-equivalent of functional group ("g/equivalent"). The g/equivalent ratio of the functional groups on the polymer particles to the complementary reactive functional groups on the multifunctional compound in the inkjet recording element of the invention ranges from 1.0/0.1 to 1.0/5.0 and more preferably from 1.0/0.2 to 1.0/2.0.

After printing an image on the media, the fusing and concurrent crosslinking should be sufficient. Under fusing can result in a tacky surface and, if the fusible, porous layer remains porous, the inkjet element will not be water and stain resistant, as well as not have the desired anti-blocking properties.

The functional group equivalent weight of the multifunctional compound is about 50 to 10,000, preferably from about 100 to 5,000, most preferably from about 100 to 2,000.

As indicated above, the polymer particles and the multifunctional compound comprise complementary reactive functional groups. For example, an epoxy-multifunctional compound can be a copolymer based on epichlorohydrin containing epoxy monomeric units which will react with amine, carboxylic acidic, hydroxyl, anhydride or the like reactive functionalities in the polymeric particles (or vice versa).

Preferred examples of oxazoline-multifunctional compounds comprise monomeric units derived from monomers such as 2-vinyl-2-oxazoline and 2-isopropenyl-2-oxazoline. Examples of multifunctional compounds with protic-type reactive functionalities include oligomers derived from acid-functional monomers such as methacrylic acid or hydroxy-functional monomers such as hydroxyalkyl(meth)acrylates, for example, hydroxyethyl(meth)acrylate.

In general, epoxy-functional reactive groups in the multifunctional compound can react with carboxylic (—COOH), alcohol (—OH), primary amine (—$NH_2$) groups or thiol groups (—SH) in the polymer particles (or vice versa), for example, polymer particles made from polymers comprising monomeric units derived from methacrylic acid (MAA), hydroxyalkylmethacrylates such as hydroxyethylmethacrylate (HEMA), or aminoalkyl methacrylates such as aminopropylmethacrylate, all common and commercially available monomers. In the case of alcohols, a catalyst such as 4-dimethylaminopyridine may be used to speed the reaction at room temperature, as will be understood by the skilled chemist.

In another embodiment, oxazoline functional groups in a multifunctional compound can similarly react with carboxylic acids, acid anhydrides, amines, phenols and thiols in the polymer particles (or vice versa). In a preferred embodiment of the invention, a multifunctional compound containing repeat units having at least one ring-opening group, an epoxide or an oxazoline, reacts with polymer particles containing repeat units having a protic group, such as a carboxylic acid containing monomer. Included among useful protic reactive monomers are acrylic, methacrylic, itaconic, crotonic, fumaric and maleic acids, and anhydrides thereof.

Suitable copolymerizable monomers for making the polymeric particles and/or the multifunctional compound include conventional vinyl monomers such as acrylates and methacrylates of the general formula:

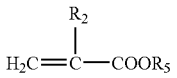

where $R_2$ is as defined above and $R_5$ is a straight chain or branched aliphatic, cycloaliphatic or aromatic group having up to 20 carbon atoms which is unsubstituted or substituted. Useful or suitable copolymerizable monomers include, for example: methyl, ethyl, propyl, isopropyl, butyl, ethoxyethyl, methoxyethyl, ethoxypropyl, phenyl, benzyl, cyclohexyl, hexafluoroisopropyl, or n-octyl-acrylates and -methacrylates, as well as, for example, styrene, alpha-methylstyrene, 1-hexene, vinyl chloride, etc.

In a preferred embodiment of this invention, the polymer particles are synthesized in a manner known per se from the corresponding monomers by an emulsion polymerization reaction customary to the person skilled in the art. Emulsion polymerization initiators for the polymer particles include water-soluble initiators capable of generating ion radicals (such as potassium or ammonium persulfate) or free-radical-generating polymerization initiators of the type illustrated by acetyl peroxide, lauroyl peroxide, decanoyl peroxide, caprylyl peroxide, benzoyl peroxide, tertiary butyl peroxypivalate, sodium percarbonate, tertiary butyl peroctoate, and azobisisobutyronitrile (AIBN). Ultraviolet free-radical initiators illustrated by diethoxyacetophenone can also be used. Additionally, a polymer can be formed by: (1) mixing the monomers together; (2) adding a polymerization initiator; (3) subjecting the monomer/initiator mixture to a source of ultraviolet or actinic radiation and/or elevated temperature and polymerizing the mixture. This polymer can then be dissolved in an appropriate solvent and the resulting solution dispersed in water with appropriate dispersing agents and sheared in a homogenizer to generate a crude emulsion. Rotary evaporation, at a temperature and vacuum condition appropriate for efficient removal of the solvent, yields a dispersion of polymer particles in water. Other methods for generating aqueous dispersions of polymer particles for use in the invention can also be invoked.

In one embodiment of the present invention, the multifunctional compound has an oxazoline group represented by the following formula:

(I)

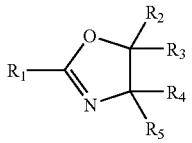

wherein $R_1$ through $R_5$ are selected so to provide a branched or unbranched vinyl oxazoline compound, for example, by selecting $R_1$ in (I) to be a branched or unbranched vinyl group according to formula (II):

(II)

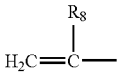

wherein $R_8$ is selected from the group consisting of hydrogen, a branched or linear $C_1$-$C_{20}$ alkyl moiety, a $C_3$-$C_{20}$ cycloalkyl moiety, a $C_6$-$C_{20}$ aryl moiety, and a $C_7$-$C_{20}$ alkylaryl moiety. If $R_1$ is such a vinyl group, $R_2$ to $R_5$ are the same or different and are selected from hydrogen, a branched or linear $C_1$-$C_{20}$ alkyl moiety, a $C_3$-$C_{20}$ cycloalkyl moiety, a $C_6$-$C_{20}$ aryl moiety and a $C_7$-$C_{20}$ alkylaryl moiety.

An oxazoline-functional unit, derived from the monomer, will provide a polymer with a moiety that is reactive to complementary reactive functionalities such as —COOH, —NH, —SH and —OH (or vice versa). A detailed discussion on the preparation of oxazoline compounds can be found in Brenton et al., "Preparation of Functionalized Oxazolines," *Synthetic Communications,* 22(17), 2543-2554 (1992); Wiley et al., "The Chemistry of Oxazolines," *Chemical Reviews*, v44, 447-476 (1949); and Frump, John A., "Oxazolines, Their Preparation, Reactions, and Applications," *Chemical Reviews*, v71, 483-505 (1971), the disclosures of which are incorporated by reference.

Examples of a multifunctional compound having an oxazoline group include polymers containing an oxazoline group as obtained by homopolymerizing an addition-polymerizable oxazoline monomer or copolymerizing said monomer with a monomer copolymerizable therewith. Examples of the addition-polymerizable oxazoline include 2-vinyl-2-oxazoline, 2-vinyl-4-methyl-2-oxazoline, 2-vinyl-5-methyl-2-oxazoline, 2-isopropenyl-2-oxazoline, 2-isopropenyl-4-methyl-2-oxazoline, 2-isopropenyl-4-ethyl-2-oxazoline, 2-isopropenyl-5-methyl-2-oxazoline, 2-isopropenyl-5-ethyl-2-oxazoline, and 2-isopropenyl-4,5-dimethyl-2-oxazoline. These may be used either alone respectively or in combinations with each other. The monomer 2-isopropenyl-2oxazoline, for example, a non-limiting example of a vinyl oxazoline, is represented by the following structure:

(III)

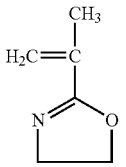

In another embodiment of the invention, a ring-opening reactive group in a multifunctional compound is provided by an epoxy-functionality polymer. The preferred epoxy-multifunctional compound is based on an oxirane-containing monomer such as epichlorohydrin, glycidyl methacrylate, allyl glycidyl ether, 4-vinyl-1-cyclohexene-1,2-epoxide, and the like, although other epoxy-containing monomers may be used. Commercially available examples of the epoxy-multifunctional compound are the phenol, 4,4'-(1-methylethylidene)bis-, polymer with (chloromethyl)oxirane available from Crompton Corporation, Middlebury, Conn., under the trademark WITCOBOND XW and the 2,2-bis(p-glycidyloxyphenyl)propane condensation product with 2,2-bis(p-hydroxyphenyl)propane and similar isomers available from Shell Corporation, Houston, Tex., under the trademark EPON 1001F. Blended mixtures of epoxy oligomers or polymers with other oligomers or polymers can also be utilized such as the commercially available polyhydroxyalcan polyglycidylether mixture available from Esprix Technologies, Sarasota, Fla., under the trademark CR-5L.

The polymeric particles are intended to flow and crosslink when fused, for example, in a heated fuser nip, thereby achieving inkjet surface coatings and media with excellent image-quality and print-durability performance.

The uppermost fusible, porous ink-transporting layer of fusible polymeric particles optionally may, in addition, contain a film-forming hydrophobic binder. The presence of a minor amount of binder may provide more pre-fusing raw-stock keeping, durability, and handling capability. The film-forming, hydrophobic binder useful in the invention can be any film-forming hydrophobic polymer capable of being dispersed in water. In a preferred embodiment of the invention, however, there is no binder. If a binder is used, it preferably should be used in a minor amount.

The particle-to-binder ratio of the particles and optional binder employed in the a fusible, porous ink-transporting layer can range between about 100:0 and 60:40, preferably between about 100:0 and about 90:10. In general, a layer having particle-to-binder ratios outside the range stated will usually not be sufficiently porous to provide good image quality.

The fusible, porous ink-transporting layer is usually present in an amount from about 1 g/m$^2$ to about 50 g/m$^2$. In a preferred embodiment, the fusible, porous ink-transporting layer is present in an amount from about 1 g/m$^2$ to about 10 g/m$^2$.

The fusible dye-trapping layer receives the ink from the uppermost ink-transporting layer, preferably retains substantially all the dye, and allows for the passage of the ink carrier liquid to the optional underlying porous carrier-liquid-receptive layer and/or the optionally porous support.

Upon fusing, via the application of heat and/or pressure, the air-particle interfaces present in the original porous structure of the image layer are eliminated, and a non-scattering, substantially continuous layer forms which contains the printed image. It is an important feature of the invention that both the fusible, porous ink-transporting layer and the underlying dye-trapping layer be transformable into a non-scattering layer as this significantly raises image density.

The fusible, polymeric particles employed in the dye-trapping layer of the invention typically range from about 0.1 μm to 10 μm, although smaller particles are possible. The particles employed in the dye-trapping layer may be formed from any polymer that is fusible, i.e., capable of being converted from discrete particles into a substantially continuous layer through the application of heat and/or pressure. In a preferred embodiment of the invention, the fusible, polymeric particles comprise the ester derivative of a natural polymer, such as cellulose acetate butyrate, a condensation polymer, such as a polyester or a polyurethane or an addition polymer, for example, a styrenic polymer, a vinyl polymer, an ethylene-vinyl chloride copolymer, a polyacrylate, poly(vinyl acetate), poly(vinylidene chloride), or a vinyl acetate-vinyl chloride copolymer, and the like.

The binder employed in the dye-trapping layer can be any film-forming polymer that serves to bind together the fusible polymeric particles. In a preferred embodiment, the binder is a hydrophobic film-forming binder derived from an aqueous dispersion of an acrylic polymer or polyurethane.

A dye mordant is preferably employed in the dye-trapping layer. Such a dye mordant can be any material that is effectively substantive to the inkjet dyes. The dye mordant removes dyes from the ink received from the porous ink-transporting layer and fixes the dye within the dye-trapping layer. Examples of such mordants include cationic lattices such as disclosed in U.S. Pat. No. 6,297,296 and references cited therein, cationic polymers such as disclosed in U.S. Pat. No. 5,342,688, and multivalent ions as disclosed in U.S. Pat. No. 5,916,673, the disclosures of which are hereby incorporated by reference. Examples of these mordants include polymeric quaternary ammonium compounds, or basic polymers, such as poly(dimethylaminoethyl)-methacrylate, polyalkylenepolyamines, and products of the condensation thereof with dicyanodiamide, amine-epichlorohydrin polycondensates. Further, lecithins and phospholipid compounds can also be used. Specific examples of such mordants include the following: vinylbenzyl trimethyl ammonium chloride/ethylene glycol dimethacrylate; poly(diallyl dimethyl ammonium chloride); poly(2-N,N,N-trimethylammonium)ethyl methacrylate methosulfate; poly(3-N,N,N-trimethyl-ammonium)propyl methacrylate chloride; a copolymer of vinylpyrrolidinone and vinyl(N-methylimidazolium chloride; and hydroxyethylcellulose derivatized with 3-N,N,N-trimethylammonium)propyl chloride. In a preferred embodiment, the cationic mordant is a quaternary ammonium compound.

In order to be compatible with the mordant, both the binder and the polymer comprising the fusible particles should be either uncharged or the same charge as the mordant. Colloidal instability and unwanted aggregation could result if the polymer particles or the binder had a charge opposite from that of the mordant.

In one embodiment, the fusible particles in the dye-trapping layer may range from about 95 to about 60 parts by weight, the binder may range from about 40 to about 5 parts by weight, and the dye mordant may range from about 2 parts to about 40 parts by weight. More preferably, the dye-trapping layer comprises about 80 parts by weight fusible particles, about 10 parts by weight binder, and about 10 parts by weight dye mordant. The dye-trapping layer is present in an amount from about 1 $g/m^2$ to about 50 $g/m^2$, more preferably in an amount from about 1 $g/m^2$ to about 10 $g/m^2$.

The optional porous ink-carrier-liquid receptive layer receives the ink carrier liquid after the ink has passed through the porous ink-transporting layer and through the porous dye-trapping layer where substantially all the dye has been removed. The ink-carrier-liquid receptive layer can be any conventional porous structure. In a preferred embodiment, the ink carrier-liquid receptive layer is present in an amount from about 1 $g/m^2$ to about 50 $g/m^2$, preferably from about 10 $g/m^2$ to about 45 $g/m^2$. The thickness of this layer may depend on whether a porous or non-porous support is used.

In general, the base ink porous ink-carrier-liquid receptive layer will have a thickness of about 1 μm to about 50 μm, and the porous ink-transporting layer residing thereon will usually have a thickness of about 2 μm to about 50 μm.

In a preferred embodiment of the invention, the ink-carrier-liquid receptive layer is a continuous, co-extensive porous layer that contains organic or inorganic particles. Examples of organic particles which may be used include core/shell particles such as those disclosed in U.S. Pat. No. 6,492,006, issued Dec. 10, 2002 to Kapusniak et al., and homogeneous particles such as those disclosed in U.S. Pat. No. 6,475,602, issued Nov. 5, 2002 to Kapusniak et al., the disclosures of which are hereby incorporated by reference. Examples of organic particles that may be used in this layer include acrylic resins, styrenic resins, cellulose derivatives, polyvinyl resins, ethylene-allyl copolymers and polycondensation polymers such as polyesters.

Examples of inorganic particles that may be used in the ink-carrier-liquid receptive layer include silica, alumina, titanium dioxide, clay, calcium carbonate, calcium metasilicate, barium sulfate, or zinc oxide.

In a preferred embodiment of the invention, the porous ink-carrier liquid receptive layer comprises from about 20% by weight to about 100% by weight of particles and from about 0% to about 80% by weight of a polymeric binder, preferably from about 80% by weight to about 95% by weight of particles and from about 20% by weight to about 5% by weight of a polymeric binder. In a preferred embodiment, the polymeric binder may be a hydrophilic polymer such as poly (vinyl alcohol), poly(vinyl pyrrolidone), gelatin, cellulose ethers, poly(oxazolines), poly(vinylacetamides), partially hydrolyzed poly(vinyl acetate/vinyl alcohol), poly(acrylic acid), poly(acrylamide), poly(alkylene oxide), sulfonated or phosphated polyesters and polystyrenes, casein, zein, albumin, chitin, chitosan, dextran, pectin, collagen derivatives, collodian, agar-agar, arrowroot, guar, carrageenan, tragacanth, xanthan, rhamsan and the like. Preferably, the hydrophilic polymer is poly(vinyl alcohol), hydroxypropyl cellulose, hydroxypropyl methyl cellulose, a poly(alkylene oxide), poly(vinyl pyrrolidinone), poly(vinyl acetate) or copolymers thereof or gelatin.

Suitable porous materials for an ink carrier-liquid receptive layer include, for example, silica or alumina in a polymeric binder. In one preferred embodiment, the ink carrier-liquid receptive layer is porous fumed alumina in a crosslinked poly(vinyl alcohol) binder.

In order to impart mechanical durability to the ink carrier-liquid receptive layer, crosslinkers which act upon the binder discussed above may be added in small quantities. Such an additive improves the cohesive strength of the layer. Crosslinkers such as carbodiimides, polyfunctional aziridines, aldehydes, isocyanates, epoxides, polyvalent metal cations, vinyl sulfones, pyridinium, pyridylium dication ether, methoxyalkyl melamines, triazines, dioxane derivatives, chrom alum, zirconium sulfate and the like may be used. Preferably, the crosslinker is an aldehyde, an acetal or a ketal, such as 2,3-dihydroxy-1,4-dioxane.

The porous ink-carrier-liquid receptive layer can also comprise an open-pore polyolefin, open-pore polyester or open-pore membrane. An open-pore membrane can be formed in accordance with the known technique of phase inversion. Examples of a porous ink-receiving layers comprising an open-pore membrane are disclosed in U.S. Pat. No. 6,497,941 issued Dec. 24, 2002 and U.S. Pat. No. 6,503,607, issued Jan. 7, 2003, both to Landry-Coltrain et al., hereby incorporated by reference.

In a particularly preferred embodiment of the invention, the ink carrier-liquid receptive layer is a continuous, co-extensive porous calcium-metasilicate-containing base layer comprising calcium-metasilicate needles, and optionally organic and/or inorganic particles in a polymeric binder, the length of the calcium metasilicate being from 1 μm to 50 μm. Although the calcium metasilicate may comprise essentially all of the particles in the layer, in a preferred embodiment, the ratio of the calcium metasilicate to the organic or inorganic particles is from 90:10 to 25:75. The calcium metasilicate is preferably present in an amount of at least 25 weight percent, based on the total dry weight of the pore-forming particles, including inorganic and/or organic particles present. The presence of the calcium metasilicate has been found to significantly help in preventing or minimizing cracking of particulate coatings upon drying and in enhancing the porous structure.

Examples of calcium metasilicate that can be used in the invention include VANSIL acicular Wollastonite. Such a material can also be represented by the commonly used formula for calcium metasilicate or $CaSiO_3$. VANSIL WG, for example, is a high aspect ratio, long needle grade of Wollastonite. Other useful grades, depending on the particular inkjet recording system, include VANSIL HR-1500 and HR-325, which are all commercially available from R.T. Vanderbilt Co., Inc., Norwalk, Conn. (webstite:www.rtvanderbilt.com).

For use in the calcium-metasilicate-containing base layer, the needles can vary in length from 1 μm to 50 μm, with the preferred length of less than 30 μm, more preferably less than 10 μm, most preferably about 2 to 9.0 μM. The average aspect ratio is suitably at least 5:1, preferably 8:1 to 20:1, more preferably about 10:1 to 16:1, most preferably at least about 12:1. The average length of the calcium metasilicate needles is suitably from 10 μm to 50 μm. The density of calcium metasilicate is typically about 2.9 $g/cm^3$. In one embodiment, the surface area ($N_2$ B.E.T.) is, for example, 1 to 4 $m^2/g$. The calcium metasilicate needles may be treated or surface modified, for example, subjected to silane treatment.

In a preferred embodiment, the calcium-metasilicate-containing base layer is a porous layer that contains organic or inorganic particles. Examples of organic particles that may be used in this layer include polymer beads, including but not limited to acrylic resins such as methyl methacrylate, styrenic resins, cellulose derivatives, polyvinyl resins, ethylene-allyl copolymers and polycondensation polymers such as polyesters. Hollow styrene or acrylic beads are preferred organic particles for certain applications.

Other examples of organic particles which may be used include core/shell particles such as those disclosed in U.S. Pat. No. 6,492,006 issued Dec. 10, 2002 to Kapusniak et al., and homogeneous particles such as those disclosed in U.S. Pat. No. 6,475,602 issued Nov. 5, 2002 to Kapusniak et al., the disclosures of which are hereby incorporated by reference.

Examples of inorganic particles that may be used in the calcium-metasilicate-containing base layer-include silica, alumina, titanium dioxide, clay, calcium carbonate, barium sulfate, or zinc oxide. In a preferred embodiment, the average primary particle size of the organic or inorganic particles is about 0.3 μm (300 nm) to about 5 μm, preferably 0.5 μm (500 nm) to less than 1.0 μm. A plurality of inorganic particles such as alumina may agglomerate into larger secondary particles.

Any polymeric binder may be used in the metasilicate-containing base layer. In general, good results have been obtained with gelatin, polyurethanes, vinyl acetate-ethylene copolymers, ethylene-vinyl chloride copolymers, vinyl acetate-vinyl chloride-ethylene terpolymers, acrylic polymer, and polyvinyl alcohol or derivatives thereof. Preferably, the binder is a water-soluble hydrophilic polymer, most preferably polyvinyl alcohol or the like.

In one preferred embodiment, the porous calcium-metasilicate-containing base layer comprises between 75% by weight and 95% by weight of particles and between about 5% and 25% by weight of a polymeric binder, preferably from about 82% by weight to about 92% by weight of particles and from about 18% by weight to about 8% by weight of a polymeric binder, most preferably about 10% by weight of binder. Preferably, the calcium-metasilicate-containing layer comprises at least 25 percent by weight of calcium-metasilicate particles (in the form of needles). In one preferred embodiment, the ratio of the needles to other organic or inorganic (substantially spherical) is about 30:70 to 70:30, preferably about 40:60 to 50:40, more preferably about 45:55 to 55:45.

The calcium-metasilicate-containing layer is typically at least 10 μm in thickness (dried), more preferably at least 15 μm or 20 μm, depending on the presence of other ink-liquid-carrier absorbing layers, preferably about 30 to 60 μm. For example, in one embodiment, the calcium-metasilicate-containing layer is 30 to 70 μm thick, preferably at least 35 μm. In the case of an inkjet recording element with a porous support such as paper, the calcium-metasilicate-containing layer may be 20 μm to 60 μm thick, preferably at least 25 μm.

The support used in the inkjet recording element of the invention may be opaque, translucent, or transparent. There may be used, for example, plain papers, resin-coated papers, various plastics including a polyester resin such as poly(ethylene terephthalate), poly(ethylene naphthalate) and poly(ester diacetate), a polycarbonate resin, a polylactic acid, a fluorine resin such as poly(tetra-fluoro ethylene), metal foil, various glass materials, and the like. In a preferred embodiment, the support is an open-structure paper support as used in the Examples below. The thickness of the support employed in the invention can be from about 12 to about 500 μm, preferably from about 75 to about 300 μm.

If desired, in order to improve the adhesion of the base layer to the support, the surface of the support may be corona-discharge-treated prior to applying the base layer or solvent-absorbing layer to the support.

Since the inkjet recording element may come in contact with other image recording articles or the drive or transport mechanisms of image recording devices, additives such as surfactants, lubricants, matte particles and the like may be added to the element to the extent that they do not degrade the properties of interest.

The layers described above, including the ink-carrier-liquid receptive layer, the dye-trapping layer, and the ink-transporting layer may be coated by conventional coating means onto a support material commonly used in this art. Coating methods may include, but are not limited to, wound wire rod coating, air-knife coating, slot coating, slide hopper coating, gravure, curtain coating and the like. Some of these methods allow for simultaneous coatings of all three layers, which is preferred from a manufacturing economic perspective.

After printing on the element of the invention, the fusible, porous ink-transporting layer is heat and/or pressure fused to form a substantially continuous overcoat layer on the surface. In addition, the dye-trapping layer is also fused at the same time. Upon fusing, these layers are rendered non-light scattering. Fusing may be accomplished in any manner that is effective for the intended purpose. A description of a fusing method employing a fusing belt can be found in U.S. Pat. No. 5,258,256, and a description of a fusing method employing a fusing roller can be found in U.S. Pat. No. 4,913,991, the disclosures of which are hereby incorporated by reference. If a fusing roller is used, it is advantageously facilitated by the low Tg reactive polymer particles of the present invention.

In a preferred embodiment, fusing is accomplished by contacting the surface of the element with a heat-fusing member, such as a fusing roller or fusing belt. Thus, for example, fusing can be accomplished by passing the element through a pair of heated rollers, heated to a temperature of about 60° C. to about 160° C., using a pressure of 5 to about 15 MPa at a transport rate of about 0.005 m/sec to about 0.5 m/sec.

As mentioned above, lower initial Tg for the fusible polymeric particles can be an advantage for fusing at relatively lower temperatures and/or lower pressures, for example less than about 300° F., instead of 350° F. as required for some prior art fusible polymeric particles of a cellulose ester. Following fusing and crosslinking, a higher Tg for the top layer of the inkjet element is obtained so that blocking problems are avoided. Also, a further advantage of inkjet media that can be made in accordance with the present invention is that, since less heat may be required to fuse the element, the inkjet element can be released from the fusing element when relatively hot without deformation and without lowering gloss or adversely affecting a smooth surface. This facilitates the use of a fuser roller as compared to a belt fuser that may otherwise be needed to provide longer contact so that the inkjet element has sufficient time to cool before release.

Dye-based inkjet inks preferably used to image the recording elements of the present invention are well known in the art. The ink compositions used in inkjet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols ate the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543; and 4,781,758, the disclosures of which are hereby incorporated by reference.

The following examples further illustrate the invention.

EXAMPLES

Polymer particle dispersions P-1 to P-7 were prepared as follows. Unless otherwise indicated, the particle size and the monodispersity were measured by a Microtrac® Ultra Fine Particle Analyzer (Leeds and Northrup) at a 50% median value.

Synthesis of Polymer Particles P-1

The polymer particle dispersions were prepared by an emulsion polymerization technique.

| | | |
|---|---|---|
| A: | Deionized water | (200 g) |
| | Potassium persufate | (0.3 g) |
| B: | Potassium persulfate | (0.8 g) |
| | ethyl methacrylate | (123.5 g) |
| | Methylacrylic acid | (6.5 g) |
| | Deionized water | (240 g) |
| | Mercaptan acid | (1.3 g) |

Part (A) was first charged to a 1 L 3-neck flask equipped with a nitrogen inlet, mechanical stirrer and condenser. The flask was immersed in a constant temperature bath at 80° C. and purged with nitrogen for 20 min.

Part (B) was added to the mixture. Agitation was maintained all the time during the feeding of the monomer emulsion. The addition time of the monomer emulsion (B) was two hours.

The polymerization was continued for 30 min after the addition of the monomer emulsion.

The mixture was cooled to room temperature and filtered. The final solids were about 22% and the final particle size was about 820 nm. The monodispersity was 1.02 as determined by UPA.

Synthesis of P-2 Polymer Particle Dispersions

The polymer particle dispersions were prepared by an emulsion polymerization technique.

| | | |
|---|---|---|
| A: | Deionized water | (100 g) |
| | Potassium persufate | (0.2 g) |
| B: | Potassium persulfate | (0.45 g) |
| | ethyl methacrylate | (45.5 g) |
| | butyl acrylate | (9.75 g) |
| | Methylacrylic acid | (9.75 g) |
| | Deionized water | (120 g) |
| | Mercaptan acid | (1.3 g) |

The same reaction procedure as for P-1 was repeated. The final solids were about 20 to 25% by weight and the final particle size was about 820 nm. The monodispersity was 1.03 as determined by UPA. Such particle dispersions can be reacted, in a fusible top layer, with multifunctional compounds having oxazoline or epoxy complementary reactive functionalities.

Synthesis of P-3 Polymer Particle Dispersions

The polymer particle dispersions were prepared the same way as the above samples except that butyl acrylate was replaced with butyl methacrylate and there was no mercaptan acid in the recipe. Since mercaptan acid is a chain transfer agent that controls molecular weight, its absence results in a higher molecular weight than previous examples. The final solids were about 22% by weight, and the final particle size was about 820 nm. The monodispersity was 1.03 as determined by UPA. Such particle dispersions can be reacted, in a fusible top layer, with multifunctional compounds having epoxy or oxazoline complementary reactive functionalities.

Synthesis of P-4 Polymer Particle Dispersions

The polymer particle dispersions were prepared the same way as for the P-1 and P-2 samples except that the monomer composition was: ethyl methacrylate 55.25 g, hydroxyethyl methacrylate 3.25 g, and butyl methacrylate 6.5 g. The final solids were about 22% by weight, and the final particle size was about 820 nm. The monodispersity was 1.02 as determined by UPA.

Synthesis of P-5 Polymer Particle Dispersions

The polymer particle dispersions were prepared the same way as the above P-1 and P-2 samples except that the monomer composition was: ethyl methacrylate 54.2 g, and dimethyl aminoethyl methacrylate 10.8 g.

The final solids were about 22% by weight, and the final particle size was about 820 nm. The monodispersity was 1.03 as determined by UPA. Such particle dispersions can be reacted, in a fusible top layer, with multifunctional compounds having acetoacetoxy complementary reactive functionalities.

Synthesis of P-6 Polymer Particle Dispersions

The polymer particle dispersions were prepared the same way as the above P-1 and P-2 samples except that the monomer composition was: ethyl methacrylate 54.2 g and acetoacetoxylethyl methacrylate 10.8 g. The final solids were about 22% by weight, and the final particle size was about 520 nm. The monodispersity was 1.04 as determined by UPA. Such particle dispersions can be reacted, in a fusible top layer, with multifunctional compounds having amino complementary reactive functionalities.

Synthesis of P-7 Polymer Particle Dispersions

The polymer particles were prepared the same way as above P-1 and P-2 samples except the monomer composition was: ethyl methacrylate 45.5 g, methyl methacrylate 13.0 g and methacrylic acid 6.5 g; and also with chain transfer agent butyl mercaptan 0.65 g. The final solids were about 22% by weight, and the final particle size was about 820 nm. The monodispersity was 1.03 as determined by UPA.

Synthesis of P-8 Polymer Particle Dispersions

The polymer particle dispersions were prepared the same way as above P-1 and P-2 samples except the monomer composition was: ethyl methacrylate 59.6 g and glycidyl methacrylate 5.4 g. The final solids were about 22% by weight, and the final particle size was about 380 nm. The monodispersity was 1.10 as determined by UPA. Such particle dispersions can be reacted, in a fusible top layer, with multifunctional compounds having carboxylic acid complementary reactive functionalities.

Various inkjet recording elements according to the present invention were prepared as follows:

Example 1

For an ink carrier-liquid receptive layer used in the following examples, a 25% solids aqueous solution was made containing calcium metasilicate (HR325 Wollastonite® from R.T. Vanderbilt Company Inc., Norwalk, Conn.), plastic pigment latex (HS3000 NA high-Tg acrylic hollow beads (1μ), from Dow Chemical, Marietta, Ga.), and polyvinyl alcohol (GH17 Gohsenol® from Nippon Gohsei, Osaka, Japan) at a dry weight ratio of 45/45/10. This was then coated and dried at a dry laydown of 26.9 g/m$^2$ (2.5 g/ft$^2$) on Domtar Quantum® 80 paper using a hopper coater.

Example 2

For a dye-trapping layer a polymeric particle dispersion comprised of ethyl methacrylate and methyl methacrylate, at the ratio of 83 to 17, the mordant divinylbenzene-co-N-vinylbenzyl-N,N,N-trimethylammonium chloride, and poly(vinyl alcohol) were diluted at the dry weight ratio of 80/10/10 to make an 18% aqueous dispersion. This was then coated over Example 1 at a dry laydown of 8.6 g/m$^2$ (0.8 g/sqft) and dried.

Comparative Example 3

For on ink-transporting layer, a polymeric particle dispersion comprised of ethyl methacrylate and methacrylic acid, at the ratio of 95 to 5 (Polymer Particle Dispersion P-1) was diluted to make an 18% aqueous solution. This was then coated over Example 2 at a dry laydown of 8.6 g/m$^2$ (0.8 g/sq ft) and dried.

Example 4

For an ink-transporting layer according to the present invention, a polymeric particle dispersion comprised of ethyl methacrylate and methacrylic acid, at the ratio of 95 to 5 (Polymer Particle Dispersion P-1) and an oxazoline functional copolymer (WS-500 from Esprix Technologies, Sarasota, Fla.), were combined so that the gram/equivalent acid functionality was equal to the gram/equivalent oxazoline functionality, to make an 18% aqueous solution. This was then coated over Example 2 at a dry laydown of 8.6 g/m$^2$ (0.8 g/sq ft) and dried.

Example 5

For an ink-transporting layer according to the present invention, a polymeric particle dispersion comprised of ethyl methacrylate and methacrylic acid, at the ratio of 95 to 5 (Polymer Particle P-1) was combined with a polyhydroxyalcan polyglycidylether functional polymer (CR-5L from Esprix Technologies) so that the gram/equivalent acid functionality was equal to the gram/equivalent polyhydroxyalcan polyglycidylether functionality, to make an 18% aqueous solution. This was then coated over Example 2 at a dry laydown of 8.6 g/m$^2$ (0.8 g/sq ft) and dried.

Comparative Example 6

For an ink-transporting layer, a polymeric particle dispersion comprised of ethyl methacrylate, butyl methacrylate, and hydroxyethyl methacrylate, at the ratio of 85 to 10 to 5 (Polymer Particle Dispersion P-4) was diluted to an 18% aqueous solution. This was then coated over Example 2 at a dry laydown of 8.6 g/m$^2$ (0.8 g/sq ft) and dried.

Example 7

For an ink-transporting layer according to the present invention, a polymeric particle dispersion comprised of ethyl methacrylate, butyl methacrylate, and hydroxyethyl methacrylate, at the ratio of 85 to 10 to 5 (Polymer Particle Dispersion P-4) was combined with a polyhydroxyalcan polyglycidylether functional polymer (CR-5L from Esprix Technologies) so that the gram/equivalent hydroxy functionality was equal to the gram/equivalent polyhydroxyalcan polyglycidylether functionality, to make an 18% aqueous solution. This was then coated over Example 2 at a dry laydown of 8.6 g/m$^2$ (0.8 g/sq ft) and dried.

Printing

Each example was then printed with a CANON i550 inkjet printer with CANON dye-based inks, with a test target comprised of 1 cm$^2$ color patches, a set of each of the primary and secondary colors. Each patch was printed at 100% density.

Fusing and Testing

The printed elements were allowed to dry for 1 hour and then were fused in a heated nip at 150° C. and 4.2 kg/cm$^2$ against a sol-gel coated polyimide belt at 76 cm/min. A drop of water, coffee, and fruit punch (Hawaiian Punch, contains Red Dye #40 and Blue Dye #1) were placed on the color patches and a white non printed area and allowed to set for 10 minutes and then blotted off. Each area where a drop was placed was visually inspected for any stain, watermarks, and deformations to the surfaces. If any stain, watermark, or deformation was detected it was assigned a fail grading. If no stain, watermark or deformation was seen it was assigned a pass grade. Table I summarizes the results:

TABLE 1

| EXAMPLE NO. | BEAD TYPE | CROSSLINKER | STAIN TEST |
|---|---|---|---|
| Comparative Example 3 | P-1 | None | Fail |
| Example 4 | P-1 | WS-500 oxazoline | Pass |
| Example 5 | P-1 | CR-5L epoxide | Pass |
| Comparative Example 6 | P-4 | None | Fail |
| Example 7 | P-4 | CR-5L epoxide | Pass |

The data clearly shows that in all cases where a crosslinking agent is used to thermally set the coatings, excellent stain resistance was obtained. When no crosslinking agent was used, poor stain resistance was obtained.

The invention has been described with reference to a preferred embodiment. However, it will be appreciated that variations and modifications can be effected by a person of ordinary skill in the art without departing from the scope of the invention.

What is claimed is:

1. An inkjet recording element comprising a support having in order thereon:

(a) a fusible, porous ink-transporting top layer, present in an amount from about 1 g/m$^2$ to about 50 g/m$^2$, comprising (i) fusible polymeric particles, having an average particles size of about 0.2 to about 2 μm, that comprise a thermoplastic polymer having reactive functionalities, wherein the thermoplastic polymer is a polyacrylate polymer or copolymer having one or more monomeric units derived from an alkyl acrylate or alkyl methacrylate monomer, wherein the alkyl group has 1 to 10 carbon atoms, wherein the fusible polymeric particles have a monodispersity less than 1.3, (ii) in addition to the fusible polymeric particles, a multifunctional compound having complementary reactive functionalities capable of reacting with the reactive functionalities on the polyacrylate polymer or copolymer to form crosslinking when fused, and (iii) in addition to the fusible polymeric particles and the multifunctional compound, optionally binder;

wherein the thermoplastic polymer in the fusible polymeric particles in the ink-transporting top layer comprise monomeric units having reactive functionalities selected from the group consisting of oxazoline, acid, acid anhydride, acetoacetoxy, primary or secondary amine, hydroxyl, phenol, thiol and isocyanate functionalities, and wherein the multifunctional compound has complementary reactive functionalities selected from the group consisting of oxazoline, epoxy, acid, acid anhydride, acetoacetoxy, primary or secondary amine, hydroxyl, phenol, thiol and isocyanate functionalities, such that the thermoplastic polymer comprising the fusible polymeric particles are crosslinked by the reaction of the reactive functionalities with the complementary reactive functionalities, after printing on the inkjet recording element and subsequent fusing;

(b) a fusible dye-trapping layer comprising fusible polymeric particles, a dye mordant, and an optional hydrophilic binder; and (c) optionally an ink-carrier-liquid receptive layer.

2. The element of claim 1 wherein an ink-carrier-liquid receptive layer is present between the support and the fusible dye-trapping layer.

3. The element of claim 1 wherein the support may optionally function as a liquid-absorbing layer either alone or in combination with an ink-carrier receptive layer.

4. The element of claim 1 wherein said fusible polymeric particles in the top layer is capable of absorbing applied ink, but wherein the top layer has essentially no hydrophilic polymer or mordant for effectively retaining a water-soluble dye.

5. The element of claim 1 wherein the fusible polymeric particles have a monodispersity less than 1.1.

6. The element of claim 1 wherein the weight average molecular weight of the thermoplastic polymer is from 5,000 to 1,000,000 and the glass transition temperature is above about 20° C. and less than 100° C.

7. The element of claim 6 wherein the Tg of the thermoplastic polymer is below 80° C.

8. The element of claim 1 wherein the fusible polymeric particles in the top layer consist of polyacrylate polymer or copolymer comprising one or more monomeric units derived from a alkyl acrylate or alkyl methacrylate monomer, wherein the alkyl group has 1 to 10 carbon atoms.

9. The element of claim 1, wherein the multifunctional compound comprises 0.1 to 100 mole percent of monomeric units having the reactive functionalities.

10. The element of claim 1, wherein the multifunctional compound comprises 0 to 99.9 mole percent of monomeric units that are derived from non-reactive monomers.

11. The element of claim 1, wherein the multi functional compound comprises 5 to 50 percent of monomeric units derived from functionally reactive monomers selected from the group consisting of epoxy and oxazoline monomers.

12. The element of claim 11, wherein the functionally reactive monomer is epichlorohydrin.

13. The element of claim 1, wherein the multifunctional compound is an epoxy-functional polymer, and the thermoplastic polymer is an acid-functional, hydroxy-functional, amine-functional, or acid-anhydride functional polymer.

14. The element of claim 1, wherein the multifunctional compound is an oxazoline-functional polymer, and the thermoplastic polymer is an acid-functional, acid-anhydride-functional, phenol-functional or thiol-functional polymer.

15. The element of claim 1 wherein between said dye-trapping layer and support is at least one porous, ink-carrier-liquid receptive layer, and wherein the porous, ink-carrier-liquid receptive layer comprises from about 50% by weight to about 95% by weight of particles and from about 50% by weight to about 5% by weight of a polymeric binder.

16. The element of claim 2 wherein the particles in the ink-carrier-liquid receptive layer comprise silica, alumina, titanium dioxide, clay, calcium carbonate, barium sulfate, zinc oxide and/or mixtures thereof.

17. The element of claim 16 wherein the ink-carrier-liquid receptive layer further comprises a polymeric binder that is poly(vinyl alcohol), hydroxypropyl cellulose, hydroxypropyl methyl cellulose, a poly(alkylene oxide), poly(vinyl pyrrolidinone), poly(vinyl acetate) or copolymers thereof, gelatin and/or combinations thereof.

18. The element of claim 2 wherein the particles in the ink-carrier-liquid receptive layer comprise organic particles.

19. The element of claim 1 wherein the fusible, polymeric particles in the fusible, porous top layer range in size from about 0.2 to about 10 μm.

20. The element of claim 1 wherein a binder is present in the fusible, porous top layer and the particle-to-binder ratio is between about 100:0 and 60:40.

21. The element of claim 1 wherein the dye mordant comprises a quaternary ammonium compound.

22. The element of claim 1 wherein the fusible polymeric particles in the fusible dye-trapping layer comprises a derivative of a natural polymer, a condensation polymer selected from the group consisting of polyester and polyurethane, or an addition polymer selected from the group consisting of a styrenic polymer, vinyl polymer, ethylene-vinyl chloride copolymer, polyacrylate, poly(vinyl acetate), poly(vinylidene chloride), and vinyl acetate-vinyl chloride copolymer.

23. The element of claim 22 wherein the fusible polymeric particles in the fusible dye-trapping layer comprise a copolymer of ethyl methacrylate and methyl methacrylate.

24. The element of claim 23 wherein the binder in the fusible, porous dye-trapping layer comprises an aqueous dispersion of an acrylic polymer or polyurethane.

25. The element of claim 1 wherein the fusible polymeric particles in the fusible dye-trapping layer are cationic or non-ionic.

26. The element of claim 20 wherein said mordant in the fusible dye-trapping layer comprises a cationic latex.

27. An inkjet printing method, comprising the steps of:

A. providing an inkjet printer that is responsive to digital data signals;

B. loading the printer with the inkjet recording element of claim 1;

C. loading the printer with a inkjet ink composition;

D. printing on the inkjet recording element using the inkjet ink composition in response to the digital data signals; and E. fusing at least the fusible, porous top layer and the dye-trapping layer such that the layers are non-porous.

28. The method of claim 27 wherein the inkjet ink composition is a dye-based ink.

29. An inkjet recording element comprising a support having in order thereon:

(a) a fusible, porous ink-transporting top layer, present in an amount from about 1 g/m$^2$ to about 50 g/m$^2$, comprising (i) fusible polymeric particles, having an average particles size of about 0.2 to about 2 μm, that comprise a thermoplastic polymer having reactive acid functionalities, wherein the thermoplastic polymer is a polyacrylate polymer or copolymer having one or more monomeric units derived from an alkyl acrylate or alkyl methacrylate monomer, wherein the alkyl has 1 to 10 carbon atoms, and wherein the fusible polymeric particles have a monodispersity less than 1.3, and (ii) in addition to the fusible polymeric particles, a multifunctional compound having complementary reactive oxazoline functionalities, capable of reacting with the reactive acid functionalities on the polyacrylate polymer or copolymer to form crosslinking when fused, such that the thermoplastic polymer comprising the fusible polymeric particles are crosslinked by the reaction of the reactive acid functionalities with the complementary reactive oxazoline functionalities, after printing on the inkjet recording element and subsequent fusing;

(b) a fusible dye-trapping layer comprising fusible polymeric particles, a dye mordant, and an optional hydrophilic binder; and (c) optionally an ink-carrier-liquid receptive layer.

* * * * *